US007867362B2

(12) United States Patent
Allen et al.

(10) Patent No.: US 7,867,362 B2
(45) Date of Patent: Jan. 11, 2011

(54) TEXTURED CELLULOSIC WET WIPES

(75) Inventors: Peter John Allen, Neenah, WI (US); Crystal Espinoza Sherman, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 365 days.

(21) Appl. No.: 12/148,624

(22) Filed: Apr. 21, 2008

(65) Prior Publication Data

US 2008/0196849 A1 Aug. 21, 2008

Related U.S. Application Data

(62) Division of application No. 10/810,974, filed on Mar. 25, 2004, now abandoned.

(51) Int. Cl.
*D21H 27/00* (2006.01)
*B32B 5/02* (2006.01)

(52) U.S. Cl. ..... 162/123; 162/109; 162/204; 206/233; 206/494; 221/63; 383/211; 424/402

(58) Field of Classification Search ..... 162/109, 162/117, 158, 123–133, 204; 428/121, 126, 428/156, 172; 221/33, 45–50, 56, 63, 303; 206/205, 209–210, 494, 449, 554, 293, 812, 206/233; 493/356–357; 424/402–404; 383/211
See application file for complete search history.

(56) References Cited

U.S. PATENT DOCUMENTS

| | | | | |
|---|---|---|---|---|
| 3,700,623 | A | 10/1972 | Keim | |
| 3,772,076 | A | 11/1973 | Keim | |
| 4,117,187 | A | 9/1978 | Adams et al. | |
| 4,131,271 | A * | 12/1978 | Slawny | 270/40 |
| 4,164,595 | A | 8/1979 | Adams et al. | |
| 4,258,849 | A | 3/1981 | Miller | |
| 4,362,781 | A | 12/1982 | Anderson | |
| 5,281,306 | A | 1/1994 | Kakiuchi et al. | |
| 5,292,581 | A | 3/1994 | Viazmensky et al. | |
| 5,629,081 | A | 5/1997 | Richards et al. | |
| 5,667,635 | A | 9/1997 | Win et al. | |
| 5,672,248 | A | 9/1997 | Wendt et al. | |
| 5,929,383 | A | 7/1999 | Marik et al. | |
| 5,964,351 | A * | 10/1999 | Zander | 206/494 |
| 6,011,195 | A | 1/2000 | Muhs et al. | |
| 6,028,018 | A | 2/2000 | Amundson et al. | |
| 6,030,331 | A * | 2/2000 | Zander | 493/356 |
| 6,245,962 | B1 | 6/2001 | Muhs et al. | |
| 6,287,426 | B1 | 9/2001 | Edwards et al. | |
| 6,436,234 | B1 | 8/2002 | Chen et al. | |
| 6,444,214 | B1 | 9/2002 | Cole et al. | |
| 6,599,848 | B1 | 7/2003 | Chen et al. | |
| 6,604,651 | B2 * | 8/2003 | Amundson et al. | 221/47 |
| 6,610,173 | B1 | 8/2003 | Lindsay et al. | |
| 6,808,790 | B2 | 10/2004 | Chen et al. | |
| 6,840,401 | B2 * | 1/2005 | Amundson | 221/56 |
| 7,037,575 | B2 | 5/2006 | Forry et al. | |
| 7,101,612 | B2 | 9/2006 | Lang et al. | |
| 7,186,318 | B2 | 3/2007 | Liu et al. | |
| 2002/0081930 | A1 | 6/2002 | Jackson et al. | |
| 2002/0096533 | A1 * | 7/2002 | Amundson et al. | 221/63 |
| 2002/0096534 | A1 * | 7/2002 | Amundson et al. | 221/63 |
| 2002/0139500 | A1 | 10/2002 | Runge et al. | |
| 2003/0070780 | A1 | 4/2003 | Chen et al. | |
| 2003/0099821 | A1 | 5/2003 | Takai et al. | |
| 2003/0157856 | A1 | 8/2003 | Schroeder | |
| 2003/0168467 | A1 | 9/2003 | Thoms | |
| 2004/0118862 | A1 * | 6/2004 | Amundson | 221/45 |
| 2005/0136780 | A1 | 6/2005 | Clark et al. | |
| 2005/0148261 | A1 | 7/2005 | Close et al. | |
| 2005/0214335 | A1 * | 9/2005 | Allen et al. | 424/402 |
| 2006/0003649 | A1 | 1/2006 | Runge et al. | |
| 2006/0147505 | A1 | 7/2006 | Tanzer et al. | |
| 2007/0048357 | A1 | 3/2007 | Shannon | |
| 2008/0196849 | A1 * | 8/2008 | Allen et al. | 162/109 |

FOREIGN PATENT DOCUMENTS

| | | | |
|---|---|---|---|
| CA | 2392858 | A1 * | 6/2003 |
| EP | 1167232 | A1 * | 1/2002 |
| EP | 0 857 453 | B1 | 5/2002 |
| WO | WO 9823519 | A1 * | 6/1998 |
| WO | WO 00/08998 | A1 | 2/2000 |
| WO | WO 03/051327 | A1 | 6/2003 |
| WO | WO 2005/103378 | A2 | 11/2005 |

(Continued)

OTHER PUBLICATIONS

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

(Continued)

*Primary Examiner*—José A Fortuna
(74) *Attorney, Agent, or Firm*—Michael J. Sullivan; Gregory E. Croft

(57) ABSTRACT

Wet wipes are made from a highly-textured basesheet of cellulose papermaking fibers bonded together with a permanent wet strength agent. The resulting wet wipes can have high wet bulk, good wet strength and can be easily dispensed and fully-opened with one hand.

34 Claims, No Drawings

FOREIGN PATENT DOCUMENTS

| | | | | |
|---|---|---|---|---|
| WO | WO 2005102132 | A1 | * | 11/2005 |
| WO | WO 2005103378 | A2 | * | 11/2005 |
| WO | WO 2008122900 | A1 | * | 10/2008 |
| WO | WO 2009143535 | A1 | * | 11/2009 |

OTHER PUBLICATIONS

TAPPI Official Test Method T 411 om-89, "Thickness (Caliper) of Paper, Paperboard, and Combined Board," published by the TAPPI Press, Atlanta, Georgia, revised 1989, pp. 1-3.

Espy, Herbert H., "Alkaline-Curing Polymeric Amine-Epichlorohydrin Resins," *Wet-Strength Resins and Their Application*, edited by Lock L. Chan, Chapter 2, TAPPI Press, Atlanta, GA, 1994, pp.14-44.

International Organization for Standardization (ISO) International Standard 3274, "Geometrical Product Specifications (GPS)—Surface Texture: Profile Method—Nominal Characteristics of Contact (Stylus) Instruments," Second edition, 1996, pp. 1-13.

International Organization for Standardization (ISO) International Standard 4287, "Geometrical Product Specifications (GPS)—Surface Texture: Profile Method—Terms, Definitions and Surface Texture Parameters," First edition, 1997, pp. 1-25.

International Organization for Standardization (ISO) International Standard 4288, "Geometrical Product Specifications (GPS)—Surface Texture: Profile method—Rules and Procedures for the Assessment of Surface Texture," Second edition, 1996, pp. 1-8.

* cited by examiner

TEXTURED CELLULOSIC WET WIPES

This application is a divisional application of U.S. application Ser. No. 10/810,974 filed Mar. 25, 2004, now abandoned. The entirety of U.S. application Ser. No. 10/810,974 is hereby incorporated by reference.

BACKGROUND OF THE INVENTION

Wet wipe products are well known in the art. They are used for wiping skin and other surfaces. A common characteristic of many of these products is that they contain synthetic fibers for strength, integrity and feel. They also tend to have a relatively flat surface texture. It has been found that when such wipes are assembled in a stack and dispensed from a tub, for example, they can be difficult to grasp, dispense and open for use. In addition, wet wipes are commonly made using processes which can be expensive and slow.

Therefore there is a need for wet wipes which are relatively inexpensive to manufacture, which open easily and which still deliver other desirable properties.

SUMMARY OF THE INVENTION

It has now been discovered that a highly-advantaged wet wipe can be made from a wet-laid throughdried basesheet comprising cellulose papermaking fibers and having a sufficient amount of a permanent wet strength. It is particularly advantageous if the basesheet is made with a high degree of surface texture, such as can be imparted by a highly-contoured three-dimensional transfer fabric or throughdrying fabric, for example. It has been found that the resulting wet wipes exhibit a host of desirable characteristics.

For example, throughdried basesheets can exhibit relatively high bulk, which not only makes better use of the fibers, but also can provide a pore structure not previously known for wet wipes. This pore structure can provide high absorbent capacity and high absorbent rate properties, which means that the wet wipes of this invention can possess a significant residual absorbent capacity after being impregnated with the wiping solution during manufacturing. This enables the user of the wet wipes of this invention to clean up spills while still taking advantage of the added cleaning ability afforded by the presence of the wet wipe solution, thus making these wipes very versatile.

Also, because the basesheet is primarily cellulosic, which also contributes to the advantageous absorbent properties, the wet wipes of this invention are more environmentally friendly than wet wipes made of synthetic fibers because they are more readily biodegradable. Furthermore, because the wet wipe consists primarily of cellulose fibers, the tear strength of the wet wipe is relatively low compared to wet wipes made of synthetic fibers. As a result, the wet wipes of this invention can be shredded and more readily dispersed at wastewater treatment facilities. At the same time, this low tear strength (measured as the wet geometric mean tear strength) does not detract from the functionality of the wet wipes of this invention because they also have high tensile strength (measured as the wet geometric mean tensile strength), high toughness (measured as the wet geometric tensile energy absorption), and good surface rubbing integrity (based on observations during testing).

In addition, the basesheet for the wet wipes of this invention can be made on a high speed tissue or towel machine, which enables the basesheet to be made relatively inexpensively compared to conventional wet wipe basesheets. Commercial tissue machines already have the capability to produce stacks of sheets or rolls of sheets, which product forms can be used for the wet wipes of this invention. Hence, for a tissue manufacturer, very few additional assets are needed to produce the wet wipe products of this invention.

At the same time, the basesheet for the wet wipes of this invention can advantageously be provided with a high degree of surface texture or three-dimensionality for improved cleaning. Furthermore, it has been found that a high degree of surface texture greatly contributes to easier dispensing because the highly-textured wet wipes do not stick to each other as readily as smooth wet wipes. As a result, when placed in a reach-in type dispensing container, each highly-textured wet wipe can be grasped easily and fully-opened with one hand, particularly when folded upon itself, unlike many relatively smooth wet wipe products on the market.

Hence, in one aspect the invention resides in a wet wipe comprising a sheet containing from about 80 to 100 dry weight percent cellulose papermaking fibers bonded together with a permanent wet strength agent and from about 50 to about 700 weight percent of a wiping solution, said wet wipe being further characterized by a dry geometric mean tensile strength of about 5000 grams or greater per 3 inches of width, a wet geometric mean tensile strength of about 1500 grams or greater per 3 inches of width and a wet sheet caliper of about 0.5 millimeter or greater.

In another aspect, the invention resides in wet wipe product comprising a stack of perpendicularly-folded wet wipes within a reach-in container, each of said wet wipes comprising a sheet containing from about 80 to 100 dry weight percent cellulose papermaking fibers bonded together with a permanent wet strength agent and from about 50 to about 700 weight percent of a wiping solution, wherein said product has a Dispensing Efficiency of about 70 percent or greater.

In another aspect, the invention resides in a wet wipe product comprising a stack of perpendicularly-folded highly-textured wet wipes within a reach-in container, each of said wet wipes having a specific surface volume ratio of about 0.25 or greater and containing from about 50 to about 700 weight percent of a wiping solution, wherein said product has a Dispensing Efficiency of about 70 percent or greater.

In another aspect, the invention resides in method of making wet wipes on a papermaking machine comprising:

(a) forming an aqueous suspension of papermaking fibers and about 0.5 dry weight percent (based on the dry weight of the fibers) or more of a permanent wet strength agent;

(b) depositing the aqueous suspension of fibers onto a moving forming fabric to form a wet web at a machine speed of about 2000 feet per minute or greater;

(c) partially dewatering the wet web;

(d) transferring the wet web to a throughdrying fabric and drying the web to substantially conform the web to the surface topography of the throughdrying fabric, wherein the resulting basesheet has a dry geometric mean tensile strength of about 5000 grams or greater per 3 inches of width and a dry sheet bulk of about 10 cubic centimeters or greater per gram; and (e) converting the basesheet into wet wipes containing from about 50 to about 700 weight percent of a wiping solution.

In another aspect, the invention resides in method of operating a commercial throughdrying papermaking machine wherein a basesheet suitable for facial tissue, bath tissue and/or paper toweling is produced and converted into facial tissue, bath tissue and/or paper toweling, wherein the same machine is thereafter used to produce a basesheet of papermaking fibers having a dry geometric mean tensile strength of about 5000 grams or greater per 3 inches of width and a dry sheet bulk of about 10 cubic centimeters or greater per gram, said basesheet thereafter being converted into wet wipes.

All of the foregoing aspects of this invention can be further defined by any combination of one or more of the specified values and ranges of the properties identified below.

As used herein, a "wet wipe" is a fibrous sheet containing a substantially uniform concentration of a wiping solution which is sold as a wet wipe to users, such as consumers, with a plurality of other like sheets.

As used herein, "perpendicularly-folded" means that there are at least two folds and at least two of the resulting fold lines are perpendicular to each other. "Quarter-folded" sheets are a particular type of perpendicularly-folded sheets in which the footprint area of the quarter-folded sheet is approximately one-fourth of the footprint area of the fully-opened sheet. There are several different fold patterns that qualify as quarter-folded. For example, the sheet can be folded in half and then folded in half again at a right angle to the first fold. A different quarter-folded pattern can be achieved by folding one edge of the sheet toward the centerline of the sheet and also folding the opposite edge toward the centerline of the sheet. If the two edges end up at or near the centerline on the same side of the sheet, this is referred to herein as a "c-fold". If the two edges end up at or near the centerline on opposite sides of the sheet, this is referred to herein as a "z-fold". In either case, thereafter folding the c-folded or z-folded sheet in half (at a right angle to the first two folds) results in a quarter-folded sheet. Other specific perpendicularly-folded fold patterns include "eighth-folded" and "sixteenth-folded", meaning the resulting footprint is one-eighth or one-sixteenth of the area of the fully-opened sheet, respectively. These last two fold patterns are particularly useful for very large sheets. Whichever folding pattern is used, it can be advantageous if the resulting footprint is square, rather than elongated, particularly if the product is intended to be placed on and dispensed from a countertop.

As used herein, the term "basesheet" is generally used to describe an intermediate dry sheet from which the final wet wipe sheets are made. Basesheets typically are sheets made on a paper machine and wound into a parent roll for subsequent converting operations. Methods suitable for making paper basesheets in accordance with this invention include wet-laid web formation coupled with throughdrying, after which the throughdried web can be creped or uncreped. Suitable basesheets and their methods of making are described in U.S. Pat. No. 5,672,248 entitled "Method of Making Soft Tissue Products" issued Sep. 30, 1997 to Wendt et al. and U.S. Pat. No. 6,436,234 B1 entitled "Wet-Resilient Webs and Disposable Articles Made Therewith" issued Aug. 20, 2002 to Chen et al, both of which are hereby incorporated by reference in their entirety to the extent they are not inconsistent herewith.

The wipes of this invention have a three-dimensional surface texture characterized by ridges and valleys and/or protrusions and depressions. In some specific embodiments, the surface texture is very noticeable to the casual observer. Commercially available examples of highly textured sheets are current Scott® brand paper towels manufactured by Kimberly-Clark Global Sales, Inc., Neenah, Wis. and Kleenex® brand Cottonelle® toilet paper with Ripples, also manufactured by Kimberly-Clark. The texture of the basesheets and wipes of this invention can be represented quantitatively by the wet caliper (hereinafter defined), which can be about 0.5 millimeter or greater. In practice, higher caliper values generally correspond with more three-dimensional texture. Alternatively, or in addition, the texture of the surface can be represented by the specific surface volume ratio (hereinafter defined), which can be about 0.25 or greater.

As previously mentioned, papermaking machines, such as tissue and paper towel machines, are particularly useful for making basesheets suitable for purposes of this invention. These machines are typically characterized by their high speed and capacity. Suitable machine speeds can be about 2000 feet per minute (fpm) or greater, more particularly from about 2500 to about 5000 fpm. Machine capacities can be about 8 tons per hour (tph) or greater, more specifically from about 9 to about 14 tph. After the basesheets are produced on the papermaking machine, usually in the form of a wound parent roll, the basesheets can be "converted" into wet wipes by any suitable method known in the wet wipe arts. The details of these converting processes will depend on the desired final product form and many combinations of operations are possible. In general, these converting operations will include, in no particular order, one or more of the following operations: rewinding the basesheet; perforating the basesheet (particularly if a rolled product form is desired); slitting and cutting the basesheet to the desired wet wipe sheet size; folding the sheets; wetting the sheets with the wiping solution; stacking the folded sheets; and packaging. Those skilled in the art of manufacturing wet wipes are very familiar with these conventional converting operations.

Fibers suitable for use in the basesheets of this invention include any natural papermaking fibers as are known in the papermaking art and generally include any cellulosic fibers such as hardwood and softwood fibers. More particularly, the fibers can be virgin fibers, recycled fibers, bleached fibers, unbleached fibers or partially bleached fibers. Fibers of various pulp types can also be used, such as mechanical pulps, semi-mechanical pulps, bleached chemithermomechanical pulps (BCTMP), and the like. Advantageously, on a dry weight percent basis, the basesheets of this invention can contain from about 80 to 100 weight percent cellulose fibers, more specifically from about 90 to 100 weight percent cellulose fibers, still more specifically from about 95 to 100 weight percent cellulose fibers. Basesheets consisting solely or essentially of cellulosic fibers are advantageous for obtaining a balance of basesheet properties and cost effectiveness.

Permanent wet strength agents useful for purposes of this invention include those permanent wet strength agents well known in the papermaking art. These agents are typically water soluble cationic oligomeric or polymeric resins that are capable of either cross-linking with themselves or with cellulose or other constituent of the wood fiber. The most widely-used materials for this purpose are the class of polymers known as polyamide-polyamine-epichlorohydrin (PAE) type resins. These materials have been described in patents issued to Keim (U.S. Pat. Nos. 3,700,623 and 3,772,076) and are sold by Hercules, Inc., Wilmington, Del. under the Kymene® trademark. Related materials are marketed by Henkel Chemical Co., Charlotte, N.C. and Georgia-Pacific Resins, Inc., Atlanta, Ga. In addition, many suitable wet strength agents are described in the text "Wet Strength Resins and Their Applications", chapter 2, pages 14-44, TAPPI Press (1994), herein incorporated by reference.

The amount of permanent wet strength agent added to the fibers of the basesheet during papermaking can be about 0.5 dry weight percent or greater, more specifically about 1 dry weight percent or greater, more specifically from about 0.5 to about 3 dry weight percent and still more specifically from about 1 to about 2 dry weight percent.

The basesheets useful for purposes of this invention can be layered or blended (homogeneous). Layered papermaking processes are well known in the art. If the sheets are layered, it can be advantageous to highly refine the fibers in the outer layers to increase the surface durability of the sheets during wiping use and/or to alter the pore structure and absorbent properties of the basesheet. A three-layered sheet is particularly advantageous, wherein one or both outer layers are highly-refined hardwood and/or softwood fibers and the center layer comprises bulky wet-resilient fibers containing a high level of lignin, such as BCTMP.

The "dry basis weight" of the basesheets useful for purposes of this invention can be from about 25 to about 85 grams per square meter (gsm), more specifically from about 40 to about 75 gsm, and still more specifically from about 50 to about 65 gsm.

The "wiping solution" incorporated into the basesheet can be any aqueous or non-aqueous liquid that is suitable for use in a wipe. Suitable wiping solutions are well known in the wipe art. The amount of wiping solution, particularly an aqueous wiping solution, which is added to and retained by the sheet can be from about 50 to about 700 weight percent based on the dry weight of the sheet, more specifically from about 100 to about 500 weight percent, and still more specifically from about 200 to about 400 weight percent. The desired amount of wiping solution contained within the basesheets will depend in part on the degree of texture in the basesheet. Basesheets with greater degrees of texture can hold greater amounts of wiping solution while still providing wet wipes that dispense efficiently.

Because of the unique combination of properties associated with the wet wipes of this invention, such as ease of dispensing, high tensile strength, low tear resistance, high surface texture, high wet bulk and the like, a number of different physical properties can be used to characterize the products. Unless otherwise stated, recited values for specific properties are intended to be "averages" based on a representative number of product samples.

The "wet sheet bulk" and/or the "dry sheet bulk" (both hereinafter defined) of the wet wipes of this invention (or their basesheets) can be about 10 cubic centimeters or greater per gram, more specifically about 15 cubic centimeters or greater per gram, more specifically from about 10 to about 35 cubic centimeters per gram (cc/g) and still more specifically from about 15 to about 25 cc/g. The wet sheet bulk and the dry sheet bulk can be substantially the same, or they can be different. The wet sheet bulk and the dry sheet bulk can be substantially the same, or they can be different. Wet sheet bulk can be increased by decreasing basis weight at the same wet caliper, or by increasing wet caliper at the same or lower basis weight.

The "wet sheet caliper" (hereinafter defined) of the wet wipes of this invention, which is an indirect measure of the three-dimensional texture of the surface of the wipe, can be about 0.5 millimeter or greater, more specifically about 0.8 millimeter or greater, more specifically about 1.0 millimeter or greater, more specifically about 1.2 millimeters or greater, more specifically from about 1.0 to about 2.0 millimeters and still more specifically from about 1.1 to about 1.5 millimeters. Wet sheet caliper can be increased by selection of a higher caliper molding fabric on which the texture and caliper of the sheet is created.

The "dry geometric mean tensile strength" (hereinafter defined) of the wet wipes of this invention, which is a measure of the strength of the dry basesheet, can be about 5000 grams or greater per 3 inches of width, more specifically about 6000 grams or greater per 3 inches of width, still more specifically from about 5000 to about 9000 grams per 3 inches of width and still more specifically from about 6000 to about 8000 grams per 3 inches of width. (As used herein with respect to strength measurements, the term "grams" represents "grams of force".) The high level of dry strength in the basesheet can be created by highly refining the basesheet fibers and/or the addition of chemical dry strength agents to the fibers prior to web formation. Suitably, this means a refining energy input of about 5 horsepower-days per ton of dry fiber or greater, or otherwise whatever refining level is needed to provide the resulting basesheet with a dry geometric mean tensile strength of about 5000 grams or greater per 3 inches of sheet width, which is an extremely high level of dry strength for a tissue or paper towel product and would be unacceptably high for a consumer household product. If used, the amount of dry strength agent added to the fibers of the basesheet during papermaking can be from about 0 to about 1 dry weight percent, more specifically from about 0.3 to about 0.7 dry weight percent. Dry geometric mean tensile strength can be increased by increasing the level of refining, dry strength agent addition, or by modifying the fiber composition to use more strong fibers such as northern softwood kraft fibers.

The "wet geometric mean tensile strength" (hereinafter defined) of the wet wipes of this invention, which is a measure of the strength in use, can be about 1500 grams or greater per 3 inches of width, more specifically about 2000 grams or greater per 3 inches of width, still more specifically from about 2000 to about 3500 grams per 3 inches of width and still more specifically from about 2500 to about 3500 grams per 3 inches of width. The wet geometric mean tensile strength can be increased by increasing the dry geometric mean tensile strength and/or by increasing the wet strength to dry strength ratio by using additional wet strength agents, such as PAE resin, in conjunction with another chemical additive such as carboxymethylcellulose.

The "wet geometric mean tensile energy absorbed" (hereinafter defined) of the wet wipes of this invention, which is a measure of their durability and is at least partially due to their high degree of texture and resulting stretch, can be about 20 gram-centimeters per square centimeter or greater, more specifically about 30 gram-centimeters per square centimeter or greater, still more specifically from about 20 to about 50 gram-centimeters per square centimeter and still more specifically from about 30 to about 40 gram-centimeters per square centimeter. The wet geometric mean tensile energy absorbed can be increased by increasing the wet geometric mean tensile strength and/or by increasing the machine direction or cross-machine direction stretch. Specifically, stretch can be increased by increased use of northern softwood kraft fibers, by increased foreshortening of the sheet prior to throughdrying and/or by selection of molding fabrics that increase the machine direction or the cross-machine direction stretch.

The "wet geometric mean tear strength" (hereinafter defined) of the wet wipes of this invention, which is indicative of how easily the wipes of this invention can be shredded at wastewater treatment facilities, can be about 120 grams or less, more specifically about 100 grams or less, still more specifically from about 40 to about 120 grams, still more specifically from about 40 to about 100 grams, and still more specifically from about 45 to about 75 grams. The wet geometric mean tear strength can be increased by inclusion of more long fibers in the sheet, such as northern softwood kraft fibers.

The "specific surface volume ratio" (hereinafter defined) of the wet wipes of this invention, which is another measure of the three-dimensional texture of the surface of the wipe, can be about 0.25 or greater, more specifically about 0.35 or greater, still more specifically from about 0.45 to about 0.7 and still more specifically from about 0.5 to about 0.6. The specific surface volume ratio can be increased by selection of a higher topography, higher caliper molding fabric on which to mold the sheet.

The "vertical absorbent capacity" of the wet wipe basesheets of this invention can be about 6.0 grams of water or greater per gram of fiber, more specifically about 7.0 grams of water or greater per gram of fiber, more specifically about 8.0 grams of water or greater per gram of fiber, more specifically about 9.0 grams of water or greater per gram of fiber, more specifically from about 7.0 to about 12 grams of water per gram of fiber, still more specifically from about 8.0 to about 12 grams of water per gram of fiber, and still more specifically from about 9.0 to about 12 grams of water per gram of fiber. The residual absorbent capacity for any particular wet wipe will depend on the amount of wiping solution incorporated into the wipe. At a typical wiping solution add-on level of about 300 weight percent, for example, the residual vertical absorbent capacity of the wet wipes of this invention can be about 3.0 grams of water or greater per gram of fiber, more specifically from about 6.0 to about 9.0 grams of water per gram of fiber. The vertical absorbent capacity can be increased by modifying the fiber content by, for example, increasing the percentage of bleached chemithermomechanical pulp (BCTMP) fibers, or softwood sulfite fibers, and/or by increasing the foreshortening of the sheet prior to through-drying.

It has also been discovered that there is a need for relatively large wet wipes packaged with a relatively small dispenser package footprint so that the use of counter space is minimized. To meet this need, the wet wipes of this invention can be quarter-folded and stacked within a reach-in dispensing container. As previously mentioned, the wet wipes of this invention can be made to dispense easily with one hand. In this regard, the "size" of the wet wipes can be about 60 square inches or greater, more specifically about 100 square inches or greater, more specifically from about 60 to about 200 square inches, still more specifically from about 80 to about 150 square inches. At the same time, the "footprint" (the projected surface area occupied by the base) of the stack of folded wipes can be about 50 square inches or less, more specifically about 35 square inches or less, and still more specifically from about 15 to about 30 square inches. Depending on the size of the individual sheets, they will have to be folded one or more times in order to fit within the desired footprint size range. It has been found that quarter-folding allows a reasonably large sheet to be stacked with a relatively small footprint and is believed to be commercially viable.

The "Dispensing Efficiency" (hereinafter defined) is a measure of how easily wet wipes "as is" can be withdrawn from their container and fully-opened with one hand. This measure only applies to wet wipes presented within a reach-in dispensing container. The Dispensing Efficiency of the wet wipes of this invention can be from about 70 to about 100 percent, more specifically from about 80 to about 100 percent, and still more specifically from about 90 to about 100 percent.

The "Normalized Dispensing Efficiency" (hereinafter defined) is similar to the Dispensing Efficiency measure just described above, but is a more general measure that is applicable to any wet wipe sheet, regardless of the dispenser or the sheet presentation. The Normalized Dispensing Efficiency is a measure of the dispensability of a wet wipe when presented in a standard reach-in container under controlled conditions. In particular, this measure can be used to quantify the dispensability of wet wipes that are packaged in a container other than a reach-in dispensing container, such as interfolded or other pop-up dispensing wet wipes, or which are not presented in folded form, such as rolls of wet wipes. For measuring the Normalized Dispensing Efficiency, the individual wet wipes are taken from their containers and reconfigured as needed to test their dispensing capability in a standard folded form from a reach-in dispenser under a standard set of conditions. The Normalized Dispensing Efficiency of wet wipe sheets in accordance with this invention can also be from about 70 to about 100 percent, more specifically from about 80 to about 100 percent, and still more specifically from about 90 to about 100 percent. The Normalized Dispensing Efficiency can be increased by increasing the texture, such as molding the sheet to a shape that reduces the contact area between adjacent surfaces when the sheet is folded or stacked.

In the interests of brevity and conciseness, any ranges of values set forth in this specification contemplate all values within the range and are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following ranges: 1-5; 14; 1-3; 1-2; 2-5; 2-4; 2-3; 3-5; 3-4; and 4-5.

The foregoing and other aspects of the invention will be described in more detail below.

Test Methods

Below are descriptions of various test methods used to determine some of the characteristics of the products of this invention.

As used herein, the "wet sheet bulk" is calculated as the quotient of the "wet sheet caliper" (hereinafter defined) of a wet wipe sheet "as is", expressed in microns, divided by the dry basis weight, expressed in grams per square meter. The resulting wet sheet bulk is expressed in cubic centimeters per gram. More specifically, the wet sheet caliper is the representative thickness of a single wet wipe sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second. The "dry sheet bulk" is calculated the same way, but starting with a dry sheet.

As used herein, the "geometric mean tensile strength" (wet or dry) is the square root of the product of the machine direction tensile strength multiplied by the cross-machine direction tensile strength. The machine direction tensile strength is the peak load per 3 inches of sample width when a sample is pulled to rupture in the machine direction. Similarly, the cross-machine direction (CD) tensile strength is the peak load per 3 inches of sample width when a sample is pulled to rupture in the cross-machine direction. The procedure for measuring wet or dry geometric mean tensile strength is the same and is as follows.

Samples for tensile strength testing are prepared by cutting a 3 inches (76.2 mm) wide by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4+/−0.04 inches (101.6+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least six (6) representative specimens are tested for each product or sheet, taken "as is", and the arithmetic average of all individual specimen tests is either the MD or CD tensile strength for the product or sheet.

When measuring the dry geometric mean tensile strength for a wet wipe sheet, the wet wipe sheet is simply air-dried to ambient moisture prior to tensile testing as described above.

In addition to measuring the tensile strengths, the tensile energy absorbed (TEA) is also reported by the MTS TestWorks® for Windows Ver. 3.10 program for each sample tested. TEA is reported in the units of grams-centimeters/centimeters squared (g-cm/cm$^2$) and is defined as the integral of the force produced by a specimen with its elongation up to the defined break point (65% drop in peak load) divided by the face area of the specimen. The "geometric mean tensile energy absorbed" (GM TEA) is the square root of the product of the MD TEA and the CD TEA.

As used herein, the "wet tear strength" is a measure of the average tearing force necessary to completely tear a wet wipe test sample in one direction where the tear is initiated from a standard slit cut into the edge of the wipe specimen being tested. The test is carried out in accordance with TAPPI method T-414 "Internal Tearing Resistance of Paper (Elmendorf-type method)" using a falling pendulum instrument (Lorentzen & Wettre Model SE 009).

More particularly, a rectangular test specimen of the wet wipe to be tested is cut out of the wet wipe sample such that the test specimen measures 63 mm (2.5 inches) in the direction to be tested (such as the MD or CD direction) and between 73 and 114 millimeters (2.9-4.6 inches) in the other direction. The specimen edges must be cut parallel and perpendicular to the testing direction (not skewed). Any suitable cutting device, such as a paper cutter, can be used. The test specimen should be taken from areas of the sample that are free of folds, wrinkles, crimp lines, perforations or any other distortions that would make the test specimen abnormal from the rest of the wet wipe material. Care should be taken to prepare and test the sample promptly without allowing any appreciable amount of the wet wipe solution to evaporate or be squeezed out of the sample.

The test specimen is then placed between the clamps of the falling pendulum apparatus with the edge of the specimen aligned with the front edge of the clamp. The "Clamp" button is pressed to close the clamps. A 20-millimeter slit is cut into the leading edge of the specimen by pushing down on the cutting knife lever until it reaches its stop. The slit must be clean with no tears or nicks. This slit will serve to start the tear during the subsequent test.

The pendulum is released by pushing down on the "Pend" button of the test instrument. The tear value, which is the force required to completely tear the test specimen, is displayed by the instrument and recorded. The test is repeated for a representative number of samples and the results are averaged. The average tear value is the wet tear strength for the direction (MD or CD) tested. The "wet geometric mean tear strength" is the square root of the product of the average MD wet tear strength and the average CD wet tear strength.

As used herein, the "specific surface volume ratio" is based on a 3-dimensional topography analysis (surface profiles), which are well defined in *Assessment Surface Topography*, Liam Blunt et al, ed., Kogan Page Publishers ISBN 1-9039-9611-2 and herein incorporated by reference. The specific surface volume ratio (Smvr) is the ratio of the total volume of space above the measured surface relative to the analysis area expressed in mm$^3$/mm$^2$. The volume is obtained by calculating the space between the points of the tissue surface and an imaginary horizontal plane at the maximum altitude of the surface. As points of reference, current commercially available Scott® brand paper towels manufactured by Kimberly-Clark Global Sales, Inc., Neenah, Wis., have a specific surface volume ratio of 0.41 m$^3$/m$^2$.

Materials and Equipment

A Form Talysurf Series 2 stylus profilometer available from Taylor-Hobson Precision Ltd., Leicester, England is used. The instrument is manufactured according to ISO accepted standards for the measurement of surface texture as discussed in the following standards: ISO 3274:1996 Geometrical Product Specifications (GPS)—Surface Texture: Profile method—Nominal characteristics of contact (stylus) instruments; ISO 4287:1997 Geometrical Product Specifications (GPS)—Surface Texture: Profile method—Terms, definitions and surface texture parameters; and ISO 4288:1996 Geometrical Product Specifications (GPS)—Surface Texture: Profile method—Rules and procedures for the assessment of surface texture all three standards herein incorporated by reference.

The profilometer operates with the installed "µltra" software, identified as K510-1038-01. The "µltra" software records the stylus position and generates an x-y-z data set as successive traces by the traverse unit are completed.

The profilometer is equipped with a laser traverse unit containing a diamond tip stylus. The traverse unit uses a laser interferometer to measure elevation (z) as it draws the stylus over the area of interest in a left-to-right direction (x). The stylus is a standard 60 mm arm length with a diamond tip that has a 2 micrometer radius of curvature.

A y-stage accessory is used to incrementally move the tissue in the y-direction after a trace in the x-direction is completed by the traverse unit.

TalyMap Universal version 2.0.20 software is used for performing calculations on the profilometer data sets.

The sample preparation equipment includes 2-inch by 3-inch glass microscope slides and 2-inch wide strip of double-sided adhesive tape, such as SCOTCH brand adhesive tape.

Sample Preparation and Handling

1. Cut out a representative 45 mm by 45 mm square area of a tissue avoiding areas of discrete, large scale embossing patterns and place the side to be analyzed facing down on a clean, smooth, hard surface.

2. Attach a 2-inch wide strip of the double-sided adhesive tape onto a 2-inch by 3-inch glass microscope slide, ensuring that there are no bubbles or wrinkles in the tape.
3. Orient the slide, tape side down, and gently drop from about a ½ inch height onto the cut tissue sample.
4. Apply minimal pressure, just enough to attach the tissue to the glass slide, so as not to deform the delicate structures.
5. Take care not to touch the mounted tissue sample on the glass slide.
6. For single-ply bath tissues, ensure the surface facing the outside of the roll is facing away from the glass slide after mounting.
7. For all two- and multi-ply facial and bath tissues, mount only a single-ply ensuring that the outside facing surface, the surface intended to be used against a person's skin, is facing away from the glass slide after mounting.

Data Collection

1. Attach the glass slide containing the sample to the y-stage with the test surface facing the stylus. Masking tape can be applied over two opposite corners of the slide. For consistency, orient the sample so that machine direction of the sample is parallel with the x-direction, the direction of stylus travel.
2. Select a 26 mm by 26 mm square area to be scanned and set the stylus to the starting point.
3. Avoid embossed areas in favor of areas with uniform background patterns or textures.
4. Room temperature and humidity were not controlled to TAPPI standards during profilometry testing. The testing was performed under ambient conditions in a climate controlled office environment.
5. Refer to the Taylor-Hobson—µltra operator's manual for locations of hardware controls, icons and menu commands.
6. The x-position (left-right) and vertical height (z) of the stylus are adjusted either with the stage controller joystick or icons on the µltra user interface. The y-position is controlled only by the y-stage icons on the µltra user interface.
7. Raise or lower the stylus so that it is positioned about 1 inch above the sample surface.
8. Adjust the X position of the stylus and the Y position of the stage so that, when looking down on the sample surface, the stylus is located at the lower left corner of the area to be scanned.
9. Lower the stylus until it almost touches the surface and click the contact icon in the z-control icon set.
10. Select 3D measurement from the Measure and Analyze menu.
11. Enter the "Y Start Position"=the current position of the y-stage (see the Instrument Status sub-window)
12. Enter the "Y End Position"=(current position plus 26 millimeters)
13. "Specify in Points (Y)" option is checked
14. Enter "Number of Points (Y)"=256
15. Confirm that "Immediate" option is checked
16. Enter "Data Length"=26 millimeters
17. Select "Measurement Speed"=0.5 mm/sec
18. Enter "Number of Points"=256
19. Click the OK button.
20. At the screen prompt, select a file name and folder and confirm that the format is "SUR".
21. Click the "Save" button (Data acquisition (scanning time) is approximately 4 hours)
22. Click "OK" on the screen prompt at the conclusion of the scan.

Data Processing and Analysis

1. Upon completion of the data acquisition, start the Talymap Universal software program.
2. Select "Open a Studiable . . . " from the File Menu and select the saved file.
3. Select the "Leveling" option from the "Operators" menu (this operation calculates any planar slope and adjusts it to zero). At the command prompt:
   Select "User Defined" in Type of Area
   Select "Include All" in "Operation on the Area"
   Click "OK"
4. Select the "Form Removal" option from the "Operators" menu (this operation identifies large-scale features (form) and calculates a polynomial function that defines a surface that fits the features. A $10^{th}$ order polynomial was chosen. At the command prompt:
   Select "User Defined" in Type of Area
   Select "Include All" in "Operation on the Area"
   Select "Polynomial of order" and "10" in "Form to remove"
   Select "Surface, Form Removed" in "Results to Provide"
   Click "OK"
5. Select the "Zoom . . . " option from the "Operators" menu. This operation is used to crop the scanned area to a desired size. Use this operator four times in succession to subdivide the 1-inch by 1-inch "map" into 4 equal ½ inch by ½ inch maps. At the command prompt:
   Confirm that the outlined area to be cropped equals ½ the width and height of the original map.
   Use the mouse cursor to move the outline to the upper left corner of the map.
   Click "OK"
6. Repeat Step 5 for the other three quadrants.
7. Select a ½ inch map by clicking on it with the mouse cursor.
8. Select "Parameters" from the "Studies" menu. A set of parameters characterizing the selected map will appear in a display.
   Click on the "calculator" icon to display a sub-window for adding or deleting parameters
   Click on "Remove all" to clear the Selected Parameters list
   Select "All Parameters" from the drop-down menu at the bottom of the sub-window
   Select Sdr from the Parameters list and click on Copy
   Select Smvr from the Parameters list and click on Copy
   Click "OK"
9. Select "Parameters" from the "Studies" menu for all subsequent ½ inch maps to automatically display Sdr and Smvr. This provides four (4) values for the parameters Specific Surface Area ratio, Sdr, and the specific surface volume ratio, Smvr, for each tissue sample.
10. Calculate and record the average value for Sdr and Smvr for each sample tested.

As used herein, "vertical absorbent capacity" is a measure of the amount of water absorbed by a paper product (single-ply or multi-ply) or a sheet, expressed as grams of water absorbed per gram of fiber (dry weight). In particular, the vertical absorbent capacity is determined by cutting a sheet of the product to be tested (which may contain one or more plies) into a square measuring 100 millimeters by 100 millimeters (±1 mm.) The resulting test specimen is weighed to the nearest 0.01 gram and the value is recorded as the "dry weight". The specimen is attached to a 3-point clamping device and hung from one corner in a 3-point clamping device such that the opposite corner is lower than the rest of the specimen, then the sample and the clamp are placed into a dish of water and soaked in the water for 3 minutes (±5 seconds). The water should be distilled or de-ionized water at a temperature of 23±3° C. At the end of the soaking time, the specimen and the clamp are removed from the water. The clamping device should be such that the clamp area and pressure have minimal effect on the test result. Specifically, the clamp area should be only large enough to hold the sample and the pressure should also just be sufficient for holding the sample, while minimizing the amount of water removed from the sample during clamping. The sample specimen is allowed to drain for 3 minutes (±5 seconds). At the end of the draining time, the specimen is removed by holding a weighing dish under the specimen and releasing it from the clamping device. The wet specimen is then weighed to the nearest 0.01 gram and the value recorded as the "wet weight". The vertical absorbent capacity in grams per gram=[(wet weight−dry weight)/dry weight]. At least five (5) replicate measurements are made on representative samples from the same roll or box of product to yield an average vertical absorbent capacity value.

As used herein, the "Dispensing Efficiency" is a measure of the ease with which wet wipes stacked within a reach-in container can be removed and fully opened with one hand. The Dispensing Efficiency is reported as the percentage of the total number of wipes within a container that meet the test criteria. More specifically, the top wipe in the stack is grasped by an exposed corner (or edge if a corner is not exposed) between the thumb and forefinger. The wipe is raised vertically about 1 foot in approximately 2 seconds in an even motion. The wipe is held for two additional seconds to see if the wipe has fully unfolded or not. For each wipe within the container, it is noted whether or not the wipe is fully unfolded. After all of the wipes within the container have been removed, the Dispensing Efficiency is the percentage of wipes removed that fully unfolded.

As used herein, the "Normalized Dispensing Efficiency" is a measure of a sheet property, namely its ability to be dispensed and fully opened with one hand. More specifically, the test method for determining the Normalized Dispensing Efficiency is designed to create a uniform condition for testing so various wet wipe products, the sheets of which may contain different moisture levels, different packaging, different fold geometry, etc. can be compared for dispensing efficiency on a similar basis. In particular, prior to dispensing testing, the various products need to be prepared so that they are similar in at least three respects, namely moisture content, fold configuration and compression (level and time). Because the wiping solution can quickly evaporate or be squeezed from the wet wipes samples being tested, it is important to carry out the test procedure as quickly as possible in order to minimize inaccuracy.

To test wipes of a particular wet wipe product for the Normalized Dispensing Efficiency, the average moisture content of the wipes must first be known in order to determine how to bring the moisture content of the test wipes to the standard test condition of 410±5 weight percent as described below. Therefore, preliminarily, ten wet wipes of the test product are removed from their package and promptly weighed to determine total weight. The ten wet wipes are then allowed to air dry and re-weighed. The weight difference, divided by the dry weight of the same ten wipes, and multiplied by 100 percent, is the average moisture content for the wet wipes tested.

If the preliminary weight percent moisture for the test product is less than 410 weight percent, an amount of distilled water equal to the moisture difference must be added to each of the test wet wipes prior to Normalized Dispensing Efficiency testing. This is performed by removing another ten wipes from their package (or ten wipes from another representative package), one at a time. Each wipe is promptly quarter-folded (initially z-folding by folding opposing edges of the wipe to the centerline of the wipe, but on opposite surfaces of the wipe, and then folding the z-folded wipe in half at a right angle to the first two fold lines) and placed on the bottom of a container of known weight having a flat bottom and which is tall enough to hold all of the folded wipes in a stack. The stack of ten folded wet wipes is then weighed while in the container. Using the ten-sheet dry weight from the preliminary dry weight measurement above and the known weight of the container, the amount of wiping solution present in the stack is determined by difference. If the amount of solution in the stack is less than 410% of the expected dry stack weight, the additional amount required for the stack to reach 410% is calculated. The amount required by the stack is divided by ten to find the additional solution to be added to each sheet in the stack. To do this, the top nine folded wipes of the stack are gently lifted above the container and a syringe is used to quickly and uniformly wet the exposed surface of the remaining wipe with the calculated amount of distilled water. The bottom wipe from the removed stack of nine is then placed into the container on top of the wipe just previously treated with distilled water. A syringe is again used to evenly distribute the calculated amount of distilled water over the exposed surface of the top wipe in the bottom of the container. This procedure is quickly repeated until all ten wipes have been stacked into the container and properly wetted.

Immediately after the ten wipes have been stacked and wetted, a flat plate, large enough to completely cover the top folded wipe yet small enough to fit within the container opening, is placed on top of the stack and a total weight of 5 kilograms is applied to the top of the stack. The total weight is the combination of the weight of the chosen plate plus any additional weight needed, which is placed on top of the center of the plate, to bring the total weight to 5 kilograms. The plate and any additional weight are left on top of the stack for one minute to uniformly compress the stack and even out any moisture irregularities. After one minute, the plate and weight are removed.

The compressed stack is then tested for one-handed dispensing as described above for the Dispensing Efficiency test. The percentage of wet wipes within the stack that fully open with one hand is the Normalized Dispensing Efficiency.

If, as described earlier, the preliminary moisture content for the test product is determined to be greater than 410 weight percent, then the wipes must first be partially dried to a known moisture content below 410 weight percent and then an amount of liquid equal to the moisture difference must be added back to each of the test wipes to bring the moisture content to 410 weight percent prior to testing as described above. The amount of drying necessary may take some trial and error. It should be noted that the residual amount of moisture within the wipes after partial drying should be as great as possible in order to ensure that the amount of added water is minimized and uniformly distributed within each wipe. If the wipes are completely dried prior to rewetting, it may be difficult to get the added water to evenly distribute itself throughout each wipe.

EXAMPLES

In order to further illustrate this invention, an uncreped throughdried basesheet was produced using the method substantially as described in the aforementioned Wendt et al.

patent. More specifically, a three-layered, single-ply, heavy-weight towel basesheet was made in which the outer layers comprised highly-refined northern softwood kraft fibers (NSWK) and the center layer comprised unrefined bleached chemi-thermomechanical softwood fibers (BCTMP). Both fibers types (NSWK and BCTMP) were pulped for 30 minutes at 7 percent consistency and diluted to 3.2 percent consistency after pulping. The overall layered sheet weight was split 30%/40%/30% among the NSWK/BCTMP/NSWK layers. The outer layers (NSWK) were refined at a level of 6 hpd/metric ton, while the center layer was unrefined. A wet-strength resin, Kymene® 557 LX, was added to each center layer at 15 kg Kymene® solids/dry metric ton of fiber (1.5% by weight).

A three-layer headbox was used to form the wet web with the refined NSWK stock in the two outer layers of the headbox and the BCTMP in the center layer. Turbulence-generating inserts recessed about three inches (75 millimeters) from the slice and layer dividers extending about one inch (25 millimeters) beyond the slice were employed. The net slice opening was about 1.1 inch (30 millimeters) and water flows in all three headbox layers were comparable. The consistency of the stock fed to the headbox was about 0.20 weight percent.

The resulting three-layer web was formed on a twin-wire, suction form roll former with Voith 2164B forming fabrics. The speed of the forming fabrics was 6.4 meters per second. The newly-formed web was then dewatered to a consistency of about 25-30 percent using vacuum suction from below the forming fabric before being transferred to the transfer fabric, which was traveling at 5.1 meters per second (25% rush transfer). The transfer fabric was a Voith T807-1. A vacuum shoe pulling about 6-15 inches (150-380 millimeters) of mercury vacuum was used to transfer the wet web to the transfer fabric.

The web was then transferred from the transfer fabric to a throughdrying fabric (Voith T1203-8). The throughdrying fabric was traveling at a speed of about 5.1 meters per second. The web was carried over a Honeycomb throughdryer operating at a temperature of about 400° F. (205° C.) and dried to final dryness of about 94-98 percent consistency.

The dry sheet was cut into squares 8.5" on each side. The square sheets were "z-folded" by folding opposing edges of the square to the centerline of the square, but on opposite surfaces of the square. (at this point the sheet, if cut perpendicular to the folds, would have a "Z-shaped" profile). The sheet was then "quarter-folded" by folding the z-construction in half to produce a square one-half of the original sheet dimension on each edge. These quarter-folded sheets were stacked, weighed and placed in a water-tight container. Distilled water was added to the stack in an amount equal to 330% of the dry stack weight. The container was sealed to prevent evaporation. The wetted stack of wet wipes was left for several hours in order for the moisture to distribute uniformly throughout the stack.

The resulting wet wipes had the following properties: dry basis weight, 60 grams per square meter; dry MD stretch, 20 percent; dry CD stretch, 10 percent; dry sheet caliper, 1.35 mm; dry geometric mean tensile strength, 8,000 grams per three-inch sample width; ratio of MD to CD dry tensile strength, 1.0; ratio of wet geometric mean tensile strength to dry geometric mean tensile strength, 0.35; dry geometric mean TEA, 75 gram-cm per $cm^2$; ratio of dry MD TEA to dry CD TEA, 2.9; wet sheet bulk, 20 cc/g; wet geometric mean TEA, 34 gram-cm per $cm^2$; ratio of wet MD TEA to wet CD TEA, 2.0; dry geometric mean raw tear strength, 79 grams; ratio of dry MD tear strength to dry CD tear strength, 0.95; wet geometric mean raw tear strength, 51 grams; and ratio of wet MD tear strength to wet CD tear strength, 1.2.

In order to further illustrate the properties of the wet wipes of this invention, Table 1 below compares certain properties of several commercially-available wiping products and the wet wipes of this invention produced in the foregoing example.

TABLE 1

| Composition | Sold as: | Product | Basis Weight (gsm) | Wet Sheet Caliper[c] (mm) | Wet Sheet Bulk (cc/g) | Wet GM Tear (g) | Dry GMT (g/3") | Wet GMT (g/3") | Wet GMTEA (g-cm/$cm^2$) | Normalized Dispensing Efficiency | Specific Surface Volume Ratio ($mm^3/mm^2$) |
|---|---|---|---|---|---|---|---|---|---|---|---|
| Contain Cellulose Fiber Only | Dry Products | Scott ® Towel | 35.6 | 0.52 | 15 | | 2550 | 944[a] | 9.0[b] | | 0.41 |
| | | Bounty ® Towel | 38.0 | 0.55 | 14 | | 2618 | 1100[a] | 11.9[b] | | |
| | | Brawny ® Towel | 45.0 | 0.45 | 10 | | 3189 | 957[a] | 8.7[b] | | |
| | | WypAll ® L10 Sani-Prep ® Dairy Towels | 45.4 | 0.36 | 8 | | 6985 | 2486 | 7.7 | | |
| | Wet Products | Invention | 60.0 | 1.2 | 20 | 51 | 8000 | 2800 | 34 | 80% | 0.58 |
| | | Hakle ® Lingettes Humidifiees[d] | 52.0 | 0.22 | 4.2 | | | 5029 | 17.5 | 0% | |
| Contain Synthetic Fiber | | Pampers ® Wipes[d] | 62.2 | 0.59 | 9.5 | 140 | | 959 | 10.1 | 0% | |
| | | Huggies ® Supreme Care ® Baby Wipes[d] | 82.2 | 0.96 | 12 | 130 | | 1805 | 13.5 | 0% | |
| | | Clorox ® Wipes[d] | 48.7 | 0.49 | 10 | 134 | | 1388 | 31.1 | 0% | |
| | | Parent's Choice ® Wipes[d] | 82.9 | 0.48 | 5.8 | 607 | | 6864 | 233 | 0% | |

Notes:
[a]Wet GMT is approximated from dry GMT multiplied by CD wet/dry ratio previously measured by alternative means not described herein.
[b]Wet GMTEA is approximated from dry GMTEA multiplied by CD wet/dry ratio measured by alternative means not described herein.
[c]Dry products wet with 300% of dry weight moisture addition.
[d]Tensile testing by alternative method not identical to the method described herein.

The data in the foregoing table further illustrates that the wet wipes of this invention have extraordinarily high wet caliper and wet bulk, very high wet GMT and wet TEA compared to wetted dry cellulose products, comparable or superior wet GMT and wet TEA (wet toughness) compared to commercially-available wet wipes, low tear strength compared to other wet wipes and unmatched dispensing efficiency.

It will be appreciated that the foregoing description and examples, given for purposes of illustration, are not to be construed as limiting the scope of this invention, which is defined by the following claims and all equivalents thereto.

We claim:

1. A wet wipe product comprising a stack of perpendicularly-folded wet wipes within a reach-in container, each of said wet wipes comprising an uncreped through-air-dried tissue sheet having a specific surface volume ratio of about 0.25 or greater and containing from about 80 to 100 dry weight percent cellulose papermaking fibers bonded together with a permanent wet strength agent and from about 50 to about 700 weight percent of a wiping solution, wherein said product has a Normalized Dispensing Efficiency of about 70 percent or greater.

2. The wet wipe product of claim 1 wherein the wet wipes are quarter-folded.

3. The wet wipe product of claim 1 wherein the wet wipes are c-folded and quarter-folded.

4. The wet wipe product of claim 1 wherein the wet wipes are z-folded and quarter-folded.

5. The wet wipe product of claim 1 wherein the wet wipes have an unfolded size of about 60 square inches or greater and the stack of folded wet wipes has a footprint of about 50 square inches or less.

6. The wet wipe product of claim 1 wherein the wet wipes have an unfolded size of from about 60 to about 200 square inches and the stack of folded wet wipes has a footprint of from about 15 to about 50 square inches.

7. The wet wipe product of claim 1 wherein the stack of folded wet wipes has a square footprint.

8. The wet wipe product of claim 1 wherein the wet wipes have a dry geometric mean tensile strength of about 5000 grams or greater per 3 inches of width.

9. The wet wipe product of claim 1 wherein the wet wipes have a wet geometric mean tensile strength of about 1500 grams or greater per 3 inches of width.

10. The wet wipe product of claim 1 wherein the wet wipes have a wet sheet caliper of about 0.5 millimeter or greater.

11. The wet wipe product of claim 1 wherein the sheet contains from about 90 to 100 dry weight percent cellulose fibers.

12. The wet wipe product of claim 1 wherein the sheet contains from about 95 to 100 dry weight percent cellulose fibers.

13. The wet wipe product of claim 1 wherein the wet wipes have a wet sheet caliper of about 1.0 millimeter or greater.

14. The wet wipe product of claim 1 wherein the wet wipes have a wet sheet caliper of about 1.2 millimeters or greater.

15. The wet wipe product of claim 1 wherein the wet wipes have a wet sheet caliper of from about 1.0 to about 2.0 millimeters.

16. The wet wipe product of claim 1 wherein the wet wipes have a specific surface volume ratio of about 0.35 or greater.

17. The wet wipe product of claim 1 wherein the wet wipes have a specific surface volume ratio of from about 0.45 to about 0.7.

18. The wet wipe product of claim 1 wherein the wet wipes have a wet tensile energy absorbed of about 20 gram-centimeters per square centimeter or greater.

19. The wet wipe product of claim 1 wherein the wet wipes have a wet tensile energy absorbed of about 30 gram-centimeters per square centimeter or greater.

20. The wet wipe product of claim 1 wherein the wet wipes have a wet tensile energy absorbed of from about 20 to about 50 gram-centimeters per square centimeter or greater.

21. The wet wipe product of claim 1 wherein the wet wipes have a wet tensile energy absorbed of about 30 to about 40 gram-centimeters per square centimeter or greater.

22. The wet wipe product of claim 1 wherein the wet wipes have a wet geometric mean tear strength of about 120 grams or less.

23. The wet wipe product of claim 1 wherein the wet wipes have a wet geometric mean tear strength of about 100 grams or less.

24. The wet wipe product of claim 1 wherein the wet wipes have a wet geometric mean tear strength of from about 40 to about 120 grams.

25. The wet wipe product of claim 1 wherein the wet wipes have a wet geometric mean tear strength of from about 40 to about 100 grams.

26. The wet wipe product of claim 1 wherein the wet wipes have a wet sheet bulk of about 10 cubic centimeters or greater per gram.

27. The wet wipe product of claim 1 wherein the wet wipes have a wet sheet bulk of from about 10 to about 35 cubic centimeters or greater per gram.

28. The wet wipe product of claim 1 having a Normalized Dispensing Efficiency of about 80 percent or greater.

29. The wet wipe product of claim 1 wherein the wet wipes have a vertical absorbent capacity of about 6.0 grams of water or greater per gram of fiber.

30. The wet wipe product of claim 1 wherein the sheet comprises two outer layers and one or more inner layers, wherein the outer layers are primarily softwood fibers.

31. A wet wipe product comprising a stack of perpendicularly-folded highly-textured wet wipes within a reach-in container, each of said wet wipes having a specific surface volume ratio of about 0.25 or greater and containing from about 50 to about 700 weight percent of a wiping solution, wherein said product has a Normalized Dispensing Efficiency of about 70 percent or greater.

32. The wet wipe of claim 31 having a specific surface volume ratio of about 0.25 or greater.

33. The wet wipe of claim 31 having a specific surface volume ratio of about 0.35 or greater.

34. The wet wipe of claim 31 having a specific surface volume ratio of from about 0.45 to about 0.7.

* * * * *